US011551829B2

(12) United States Patent
Chen et al.

(10) Patent No.: US 11,551,829 B2
(45) Date of Patent: Jan. 10, 2023

(54) ELECTRONIC DEVICE

(71) Applicant: Industrial Technology Research Institute, Hsinchu (TW)

(72) Inventors: Hung-Yi Chen, New Taipei (TW); Yen-Ching Kuo, Keelung (TW); Hong-Ming Dai, Tainan (TW); Shu-Tang Yeh, Taichung (TW); Wen-Lung Chen, Miaoli County (TW); Jane-Hway Liao, Hsinchu County (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 0 days.

(21) Appl. No.: 17/466,872

(22) Filed: Sep. 3, 2021

(65) Prior Publication Data

US 2022/0068519 A1 Mar. 3, 2022

Related U.S. Application Data

(60) Provisional application No. 63/074,221, filed on Sep. 3, 2020.

(51) Int. Cl.
*G09F 9/30* (2006.01)
*H01B 7/04* (2006.01)

(52) U.S. Cl.
CPC ..... *H01B 7/04* (2013.01); *G09F 9/301* (2013.01)

(58) Field of Classification Search
CPC ..... G09F 9/301; G06F 1/1616; G06F 1/1652; G06F 2203/04102; H01B 7/04; H01L 51/0097
See application file for complete search history.

(56) References Cited

U.S. PATENT DOCUMENTS

| | | | |
|---|---|---|---|
| 9,601,557 | B2 | 3/2017 | Yang et al. |
| 10,038,163 | B2 | 7/2018 | Kim et al. |
| 10,135,011 | B2 | 11/2018 | Park et al. |
| 10,209,602 | B2 | 2/2019 | Harris |

(Continued)

FOREIGN PATENT DOCUMENTS

| | | | |
|---|---|---|---|
| CN | 109786428 A | | 5/2019 |
| JP | 2020120013 A | * | 8/2020 |
| TW | I674687 B | | 10/2019 |

*Primary Examiner* — Joe H Cheng

(57) ABSTRACT

The disclosure provides an electronic device. The electronic device includes a stretchable substrate, a plurality of electronic elements, and at least one connection element. The electronic elements and the connection element are disposed on the stretchable substrate. The connection element is disposed between two adjacent electronic elements, and the two adjacent electronic elements are electrically connected to each other via the connection element. Each electronic element may include at least one functional unit and an electrode, wherein the electrode is in direct contact with the functional unit. The connecting element includes at least one stretchable conductive unit and at least one buffer conductive unit, wherein the buffer conductive unit contacts the electrode, and the stretchable conductive unit is electrically connected to the electrode through the buffer conductive unit. The yield strain of the stretchable conductive unit is greater than the yield strain of the buffer conductive unit.

20 Claims, 10 Drawing Sheets

(56) References Cited

U.S. PATENT DOCUMENTS

| | | | | |
|---|---|---|---|---|
| 10,211,273 | B2 | 2/2019 | Lee et al. | |
| 10,608,071 | B2 | 3/2020 | Hong et al. | |
| 2014/0232956 | A1* | 8/2014 | Kwon | G02F 1/133305 349/12 |
| 2018/0047802 | A1* | 2/2018 | Yoon | H01L 27/3276 |
| 2018/0090699 | A1 | 3/2018 | Shin et al. | |
| 2018/0114947 | A1 | 4/2018 | Kwon | |
| 2018/0331319 | A1* | 11/2018 | Hiraga | H01L 27/3276 |
| 2019/0221631 | A1 | 7/2019 | Kim et al. | |
| 2019/0259825 | A1 | 8/2019 | Hong et al. | |
| 2020/0006684 | A1* | 1/2020 | Liu | H01L 27/3276 |
| 2020/0013970 | A1* | 1/2020 | Wang | H01L 27/3276 |
| 2020/0212021 | A1* | 7/2020 | Yueh | H01L 25/167 |
| 2021/0125784 | A1* | 4/2021 | Miyauchi | H01G 4/232 |

* cited by examiner

ELECTRONIC DEVICE

CROSS REFERENCE TO RELATED APPLICATIONS

This application claims the benefit of U.S. Provisional application Ser. No. 63/074,221, filed on Sep. 3, 2020, which is hereby incorporated herein by reference.

TECHNICAL FIELD

The disclosure relates to an electronic device.

BACKGROUND

In recent years, with the development of display technology and sensing technology, the demand for flexible electronic devices (such as flexible display, foldable display, smart skin or wearable devices) is increasing. The substrate of flexible electronic devices should have curved, rollable, bendable, foldable, flexible and stretchable characteristics. The conductive lines of flexible electronic devices for electrical connection should also have the characteristics of flexibility, stretchability and recoverability, to prevent any reduction in the reliability of the flexible electronic device.

However, the conductive lines used in electronic devices are not generally stretchable. Therefore, with repeated bending, folding or stretching of the flexible electronic device, these conductive lines in the flexible electronic device will become damaged or break due to the high strain.

Therefore, a novel flexible electronic device to solve the aforementioned problem is called for.

SUMMARY

The embodiment of the disclosure provides an electronic device. The electronic device includes a stretchable substrate, a plurality of electronic elements and at least one connecting element. The electronic elements and the connecting element are disposed on the stretchable substrate. The connecting element is disposed between two adjacent electronic elements, in order to electrically connect the two adjacent electronic elements. Each electronic element may include at least one functional unit and an electrode, wherein the electrode is in direct contact with the functional unit. The connecting element includes at least one stretchable conductive unit and at least one buffer conductive unit, wherein the buffer conductive unit contacts the electrode, and the stretchable conductive unit is electrically connected to the electrode through the buffer conductive unit. The yield strain of the stretchable conductive unit is greater than the yield strain of the buffer conductive unit.

A detailed description is given in the following embodiments.

DETAILED DESCRIPTION

Figure 1:
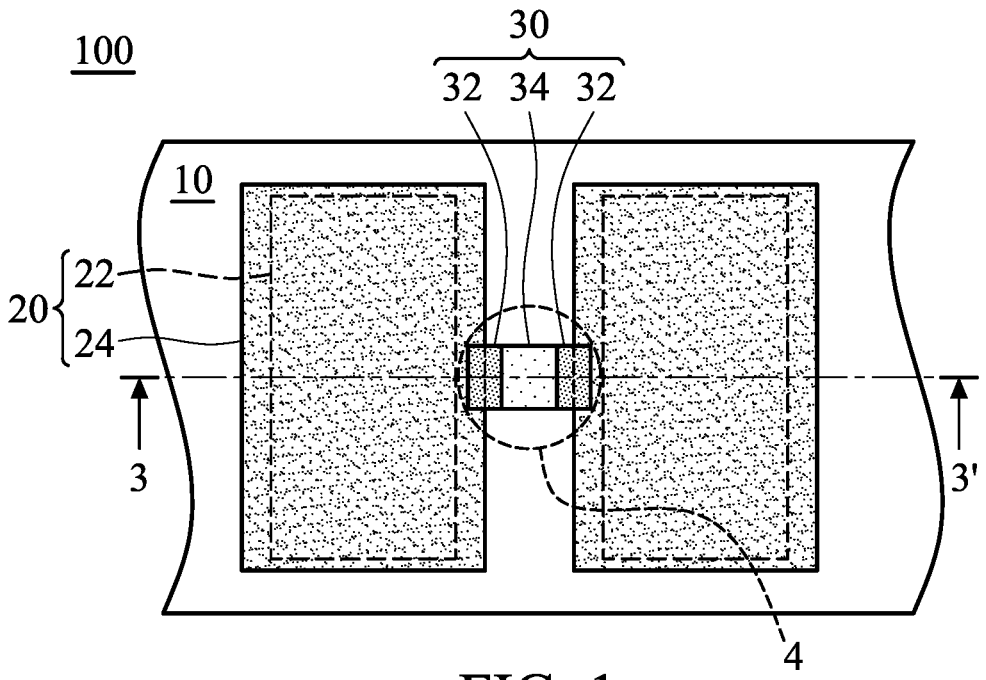
FIG. 1 shows a schematic top view of the electronic device 100 according to an embodiment of the disclosure.

The electronic device of the disclosure is described in detail in the following description. In the following detailed description, for purposes of explanation, numerous embodiments are set forth in order to provide a thorough understanding of the present disclosure. The elements and configurations described in the following detailed description are set forth in order to clearly describe the present disclosure. It will be apparent, however, that the exemplary embodiments set forth herein are used merely for the purpose of illustration, and the inventive concept may be embodied in various forms without being limited to those exemplary embodiments. As used herein, the term "about" in quantitative terms refers to plus or minus an amount that is general and reasonable to persons skilled in the art.

As used herein, the term "about" in quantitative terms refers to plus or minus an amount that is general and reasonable to persons skilled in the art.

Moreover, the use of ordinal terms such as "first", "second", "third", etc., in the disclosure to modify an element does not by itself connote any priority, precedence, or order of one claim element over another or the temporal order in which it is formed, but are used merely as labels to distinguish one claim element having a certain name from another element having the same name (but for use of the ordinal term) to distinguish the claim elements.

It should be noted that the elements in the drawings of the disclosure may be present in any form or configuration known to those skilled in the art. In addition, the expression "a layer is disposed on another layer" may refer to a layer that is in direct contact with the other layer, and they may also refer to a layer that does not directly contact the other layer, there being one or more intermediate layers disposed between the layer and the other layer.

The drawings described are only schematic and are non-limiting. In the drawings, the size, shape, or thickness of some of the elements may be exaggerated and not drawn on scale for illustrative purposes. The dimensions and the relative dimensions do not correspond to actual location to practice of the disclosure. The disclosure will be described with respect to particular embodiments and with reference to certain drawings but the disclosure is not limited thereto.

The disclosure provides an electronic device, such as a flexible electronic device. According to embodiments of the disclosure, in the flexible electronic device, the electrical connection between two adjacent electronic elements may be achieved by a connecting element. A connecting element is disposed between the electronic elements in the disclosure. As a result, stress aggregation may be avoided to prevent the conductive line in the electronic device from breaking due to stress when the electronic device is bent, curled or folded.

In detail, according to embodiments of the disclosure, the connecting element may include a stretchable conductive unit and a buffer conductive unit. By means of the specific relationship of yield strain between the electrode, the stretchable conductive unit and buffer conductive unit, the connecting element may effectively disperse the stress, so that the conductive lines in the electronic device will not be damaged or broken due to repeated bending, folding or stretching of the electronic device, and may increase the amplitude of bending, folding or stretching. As a result, the electronic device according to an embodiment of the disclosure may meet the requirements of stretchable electronic device on the premise that the in functional stability of electronic device is ensured.

In addition, according to embodiments of the disclosure, the preparation of connecting element may be integrated with the process of the electronic device without introducing additional process steps to form the connecting element, when the stretchable conductive unit and the buffer conductive unit of the connecting element are formed of the same material. Namely, the mask pattern used in the existing process steps may be modified for the formation of the connecting element.

According to embodiments of the disclosure, electronic device may be display device, wearable device, the stretchable/flexible solar panel, sensing device or device with display and sensing functions. For example, the display device may be liquid crystal display (LCD), organic light-emitting diode (OLED) display, quantum dot display, or micro-light-emitting diode (micro-LED) display. According to embodiments of the disclosure, the sensing device may be flexible sensor or organic photo sensor.

Figure 2:
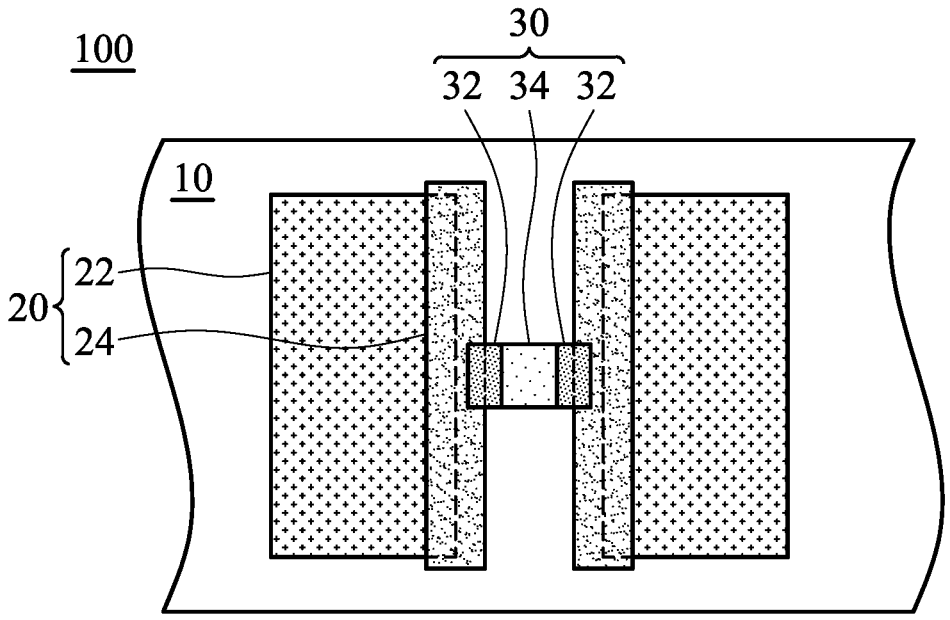
FIG. 2 shows a schematic top view of the electronic device 100 according to another embodiment of the disclosure.

FIG. 1 shows a schematic top view of the electronic device 100 according to an embodiment of the disclosure. The electronic device 100 include stretchable substrate 10, a plurality of electronic elements 20 and at least one connecting element 30. The electronic elements 20 and the connecting element 30 may be disposed on the stretchable substrate 10. As shown in FIG. 1, the connecting element 30 is disposed between two adjacent electronic elements 20 in order to achieve the electrical connection of the two adjacent electronic elements 20. According to embodiments of the disclosure, the electronic element 20 may include at least one functional unit 22 and an electrode 24, wherein the functional unit 22 may be a display unit or sensor cell. According to embodiments of the disclosure, the electrode 24 may be disposed on the functional unit 22 to completely cover the functional unit 22, and the electrode 24 is in direct contact with the functional unit 22 (i.e. the orthogonal projection of the functional unit 22 onto the stretchable substrate 10 is within the orthogonal projection of the electrode 24 onto the stretchable substrate 10), as shown in FIG. 1. In addition, according to another embodiment of the disclosure, the electrode 24 may be disposed on the functional unit 22 and is in direct contact with the functional unit 22, wherein the electrode 24 partially covers the functional unit 22, as shown in FIG. 2. According to embodiments of the disclosure, the electronic element 20 may include a plurality of functional unit 22, and the electrode 24 may be a continuous electrode film covering the plurality of functional unit 22. In addition, the electrode 24 may be patterned to form a non-continuous film, and may be designed to couple a plurality of functional unit 22 according to requirements.

According to embodiments of the disclosure, suitable material of the stretchable substrate 10 may be polyimide (PI), polycarbonate (PC), polyethersulfone (PES), polynorbornene (PNB), polyetherimide (PEI), polyethylene naphthalate (PEN), polyethylene terephthalate (PET), thermoplastic polyurethane (TPU), polydimethylsiloxane (PDMS) or a combination thereof.

According to embodiments of the disclosure, as shown in FIG. 1, the connecting element 30 may include at least one buffer conductive unit 32 and at least one stretchable conductive unit 34. The stretchable conductive unit 34 is in direct contact with the buffer conductive unit 32, the stretchable conductive unit electrically connects to the electrode electrical connection via the buffer conductive unit.

Figure 3:
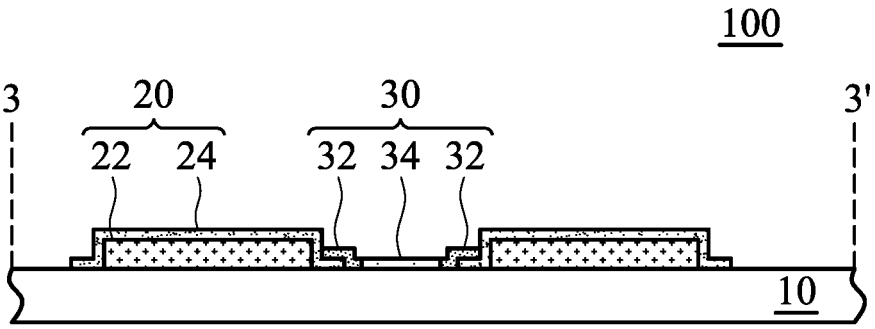
FIG. 3 shows a cross-sectional view of the electronic device 100 taken along line 3-3' of FIG. 1.

FIG. 3 shows a cross-sectional view of the electronic device 100 taken along line 3-3' of FIG. 1. As shown in FIG. 3, the buffer conductive unit 32 may be disposed to electrically connect with the electrode 24. According to embodiments of the disclosure, the stretchable conductive unit 34 is separated from the electrode 24 through the buffer conductive unit 32. Namely, the stretchable conductive unit 34 is not in direct contact with the electrode 24 of the electronic element 20.

As shown in FIG. 1 and FIG. 3, the connecting element 30 may include two buffer conductive units 32 and one stretchable conductive unit 34, wherein the stretchable conductive unit 34 may be disposed between the two buffer conductive units 32. According to embodiments of the disclosure, the buffer conductive unit 32 contacts the electrode 24 to achieve an electrical connection. In the connecting element 30, the yield strain of the whole stretchable conductive unit 34 is greater than the yield strain of the buffer conductive unit 32. Therefore, in the connecting element 30, the stretchable conductive unit 34 may have relatively high stretchability, thereby enhancing the stress relieving ability of the connecting element 30. Further, the buffer conductive unit 32 may provide stress buffering, thereby offsetting the stress aggregation (such as the stress aggregation between the stretchable conductive unit and the electrode) of the contact during stretching. Herein, the term "yield strain" refers to the level of strain at the yield point usually expressed as a percent strain. The term "yield point" refers to the point on an engineering stress versus strain curve beyond which deformation is not completely recoverable.

According to embodiments of the disclosure, the yield strain of the stretchable conductive unit 34 may be from 1% to 30%. According to embodiments of the disclosure, the yield strain of the buffer conductive unit 32 may be from 0.5% to 6%. According to embodiments of the disclosure, the deviation between the yield strain of the whole stretchable conductive unit 34 and the yield strain of the buffer conductive unit 32 is from 0.5% to 25%.

According to embodiments of the disclosure, the yield strain of the buffer conductive unit 32 is greater than the yield strain of the electrode 24 of the electronic element 20. In addition, the yield strain of the electrode 24 of the electronic element 20 may be from 0% to 1%. According to embodiments of the disclosure, the electrode 24 of the electronic element 20 cannot be elastically deformed. According to embodiments of the disclosure, the deviation between the yield strain of the whole electrode 24 and the yield strain of the buffer conductive unit 32 is from about 0.5% to 6%.

According to embodiments of the disclosure, the buffer conductive unit 32 may consist of a first material, and the stretchable conductive unit 34 may consist of a second material. In order to ensure that the yield strain of the whole stretchable conductive unit 34 is greater than the yield strain of the buffer conductive unit 32, the material of the buffer conductive unit 32 is distinct from the material of the stretchable conductive unit 34, i.e. the first material is distinct from the second material.

According to embodiments of the disclosure, the Young's modulus of the first material is distinct from the Young's modulus of the second material. In order to ensure that the yield strain of the whole stretchable conductive unit 34 is greater than the yield strain of the buffer conductive unit 32, the Young's modulus of the first material is greater than the Young's modulus of the second material. According to embodiments of the disclosure, the electrode 24 of the electronic element 20 may consist of a third material, wherein the Young's modulus of the third material is greater than the Young's modulus of the first material.

According to embodiments of the disclosure, in order to reduce the resistance of the connecting element 30, the resistivity of the first material and second material may be less than or equal to $2.44\times10^{-4}$ Ω·m, such as between $2.44\times10^{-4}$ Ω·m and $1\times10^{-11}$ Ω·m. According to embodiments of the disclosure, the first material and second material may be independently aluminum (Al), copper (Cu), molybdenum (Mo), titanium (Ti), platinum (Pt), iridium (Ir), nickel (Ni), chromium (Cr), silver (Ag), gold (Au), tungsten (W) or an alloy thereof. For example, the first material and second material may be independently silver-containing alloy, gold-containing gold, copper zinc alloy or nickel titanium alloy. According to embodiments of the disclosure, the first material and the second material may be independently conductive rubber or conductive silicon glue. According to embodiments of the disclosure, the electrode 24 may be conductive material, such as indium tin oxide (ITO), indium zinc oxide (IZO), aluminum oxide zirconium (AZO), zinc oxide (ZnO), tin dioxide ($SnO_2$), indium trioxide ($In_2O_3$), aluminum (Al), copper (Cu), molybdenum (Mo), titanium (Ti), platinum (Pt), iridium (Ir), nickel (Ni), chromium (Cr), silver (Ag), gold (Au), tungsten (W) or a combination thereof. According to embodiments of the disclosure, the method for forming the buffer conductive unit 32, the stretchable conductive unit 34 and the electrode 24 is not limited and may be optionally modified by a person of ordinary skill in the field, such as sputtering, electron beam evaporation, thermal evaporation, chemical vapor deposition, or thick film coating operation (such as ink-jet printing, screen printing or transfer printing).

According to embodiments of the disclosure, the buffer conductive unit 32 may consist of a first material, the stretchable conductive unit 34 may consist of a second material, and the first material and the second material may be made of the same conductive material. Herein, in order to force the yield strain of the whole stretchable conductive unit 34 is greater than the yield strain of the buffer conductive unit 32, the conductive material layout density of the buffer conductive unit 32 is greater than the conductive material layout density of the of the stretchable conductive unit 34. Herein, the term "conductive material layout density" refers to the volume percentage of conductive material per unit volume. Since the conductive material layout density of the buffer conductive unit 32 is greater than the conductive material layout density of the stretchable conductive unit 34, the yield strain of the buffer conductive unit 32 is less than the yield strain of the stretchable conductive unit 34.

Figure 4:
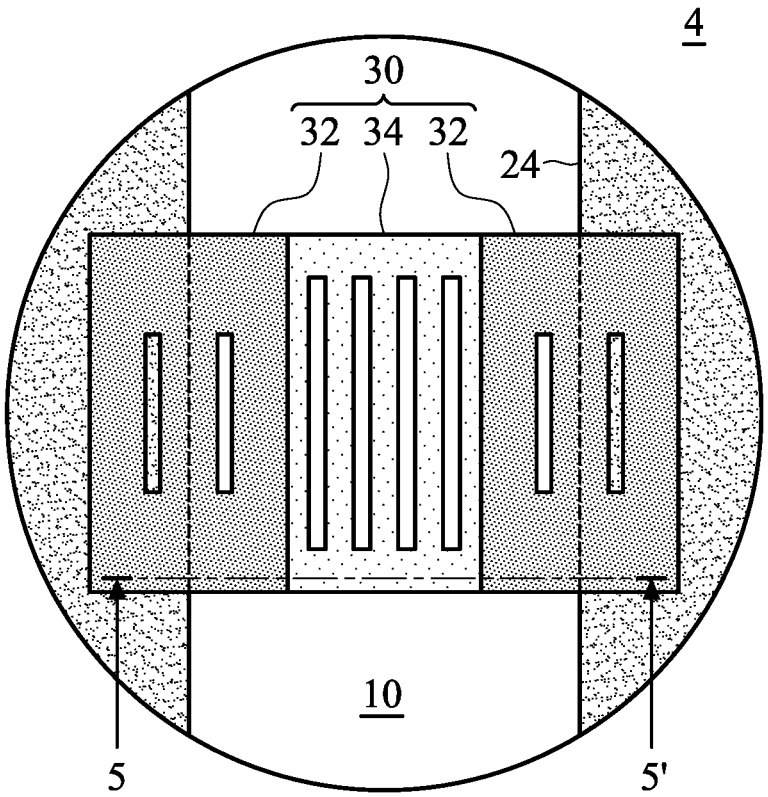
FIG. 4 shows a close-up schematic view of the region 4 in the electronic device 100 as shown in FIG. 1.
Figure 5:
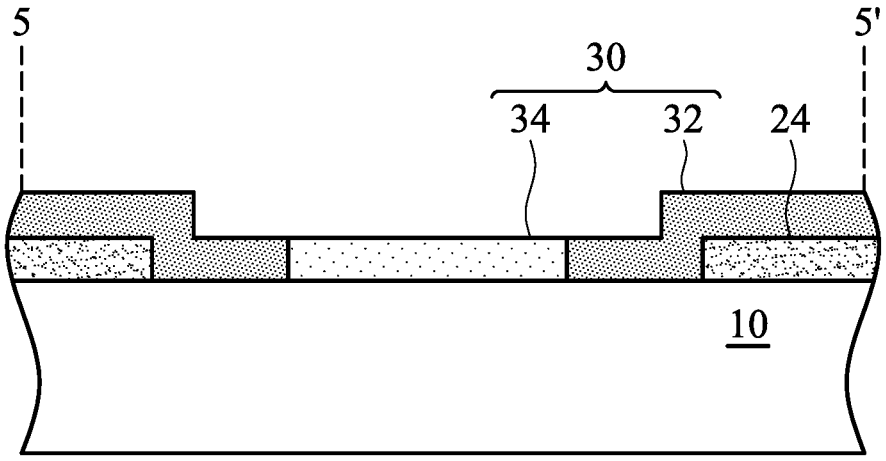
FIG. 5 shows a cross-sectional view of the region 4 of FIG. 4 in the electronic device 100 taken along line 5-5'.

According to embodiments of the disclosure, the conductive material layout density of the buffer conductive unit 32 may be controlled to be greater than the conductive material layout density of the stretchable conductive unit 34 by performing a patterning process of the conductive material, resulting in that the yield strain of the stretchable conductive unit 34 is greater than the yield strain of the buffer conductive unit 32. FIG. 4 shows a close-up schematic view of the region 4 in the electronic device 100 as shown in FIG. 1, and FIG. 5 shows a cross-sectional view of the region 4 of FIG. 4 in the electronic device 100 taken along line 5-5'. In this embodiment, the conductive material of the buffer conductive unit 32 and the conductive material of the stretchable conductive unit 34 may be further patterned. As shown in FIG. 4 and FIG. 5, since the conductive material removal amount of the buffer conductive unit 32 in the patterning process is less than the conductive material removal amount of the stretchable conductive unit 34, the conductive material layout density of the buffer conductive unit 32 is higher than that of the stretchable conductive unit 34. The buffer conductive unit 32 and the stretchable conductive unit 34 are made of the same conductive material, the yield strain of the buffer conductive unit 32 with relatively high conductive material layout density is less than that of the stretchable conductive unit 34 with relatively low conductive material layout density.

Figure 6:
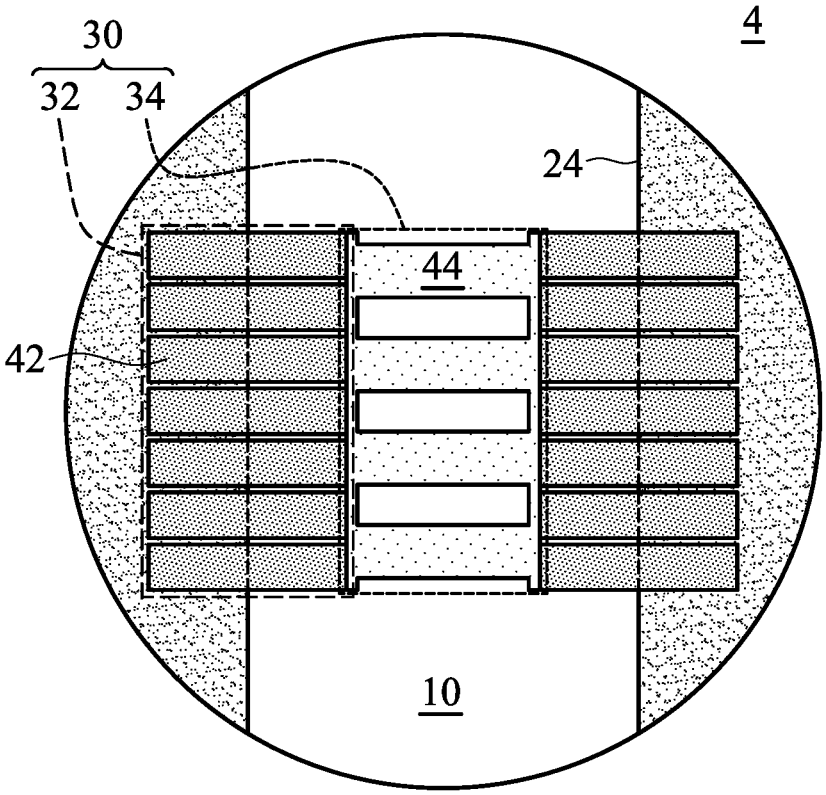
FIG. 6 shows a close-up schematic view of the region 4 in the electronic device 100 according to other embodiments of the disclosure.

According to embodiments of the disclosure, the conductive material layout density of the buffer conductive unit 32 may be controlled to be greater than the conductive material layout density of the stretchable conductive unit 34 by controlling the amount of the conductive lines, resulting in that the yield strain of the stretchable conductive unit 34 is greater than the yield strain of the buffer conductive unit 32. FIG. 6 shows a close-up schematic view of the region 4 in the electronic device 100 according to other embodiments of the disclosure. In this embodiment, the buffer conductive unit 32 includes n number of a first conductive line 42, and the stretchable conductive unit 34 includes m number of a second conductive line 44. According to embodiments of the disclosure, the first conductive line 42 and the second conductive line 44 may be made of the same material. As shown in FIG. 6, the first conductive line 42 and the second conductive line 44 have the same wire diameter. Namely, the buffer conductive unit 32 and the stretchable conductive unit 34 may be composed of conductive lines with the same wire diameter, and the difference is that the number of conductive lines of the buffer conductive unit 32 is greater than the number of conductive lines of the stretchable conductive unit 34 (i.e. n is greater than m). n is greater than or equal to 2, and m is greater than or equal to 2. Since the number of conductive lines in the buffer conductive unit 32 is greater than the number of conductive lines in the stretchable conductive unit 34, the conductive material layout density of the buffer conductive unit 32 is greater than the conductive material layout density of the stretchable conductive unit 34. As a result, the yield strain of the buffer conductive unit 32 having more conductive lines may be less than the yield strain of the stretchable conductive unit 34 having fewer conductive lines.

Figure 7:
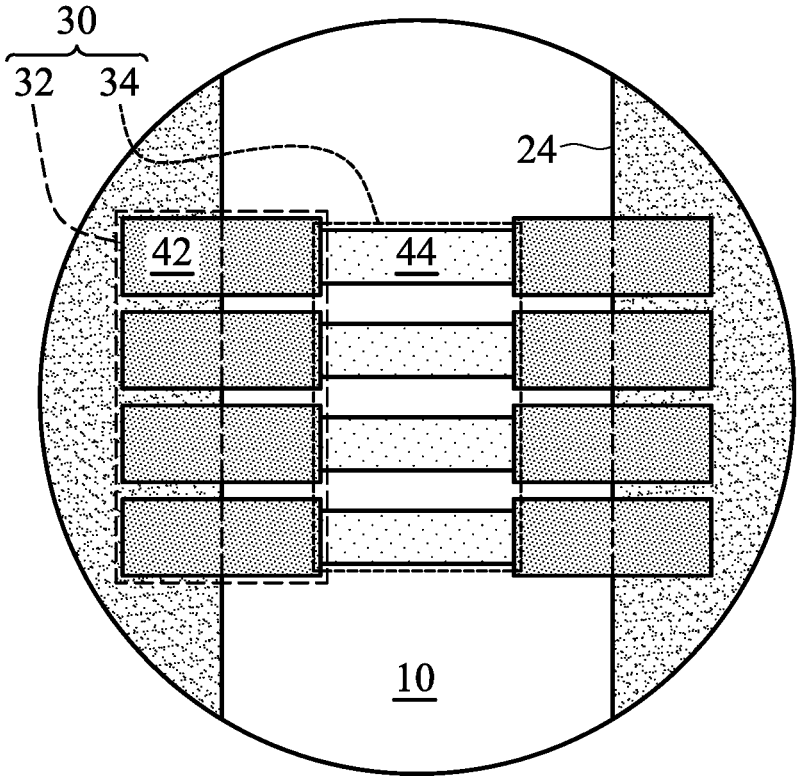
FIG. 7 shows a close-up schematic view of the region 4 in the electronic device 100 according to other embodiments of the disclosure

According to embodiments of the disclosure, the conductive material layout density of the buffer conductive unit 32 may be controlled to be greater than the conductive material layout density of the stretchable conductive unit 34 by controlling the wire diameter of the conductive lines, resulting in that the yield strain of the stretchable conductive unit 34 is greater than the yield strain of the buffer conductive unit 32. FIG. 7 shows a close-up schematic view of the region 4 in the electronic device 100 according to other embodiments of the disclosure. In this embodiment, the first conductive line 42 and the second conductive line 44 may be made of the same material. The buffer conductive unit 32 includes n number of the first conductive line 42, the stretchable conductive unit 34 includes m number of the second conductive line 44, wherein n is equal to m, and n is greater than or equal to 2, and m is greater than or equal to 2. As shown in FIG. 7, the wire diameter of the first conductive line 42 is greater than the wire diameter of the second conductive line 44. Namely, the number of conductive lines in the buffer conductive unit 32 may be the same as the number of conductive lines in the stretchable conductive units 34, the difference is that the wire diameter of the conductive line in the buffer conductive unit 32 is greater than the wire diameter of the conductive line in the stretchable conductive unit 34. Since the wire diameter of the conductive line in the buffer conductive unit 32 is greater than the wire diameter of the conductive line in the stretchable conductive unit 34, the conductive material layout density of the buffer conductive unit 32 is greater than the conductive material layout density of the stretchable conductive unit 34. As a result, the yield strain of the buffer conductive unit 32 is less than the yield strain of the stretchable conductive unit 34.

Figure 8:
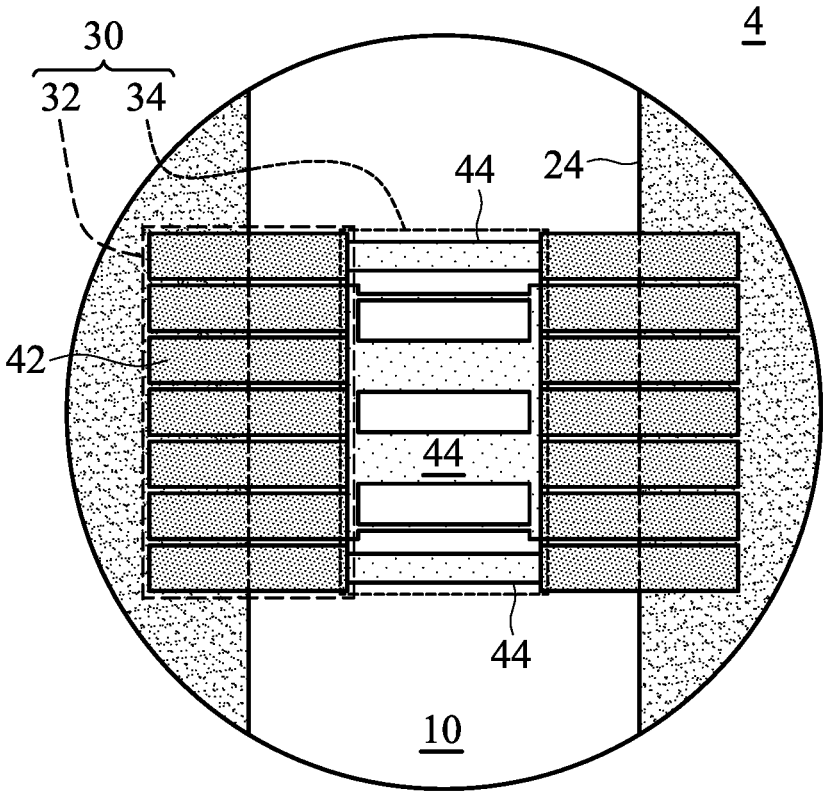
FIG. 8 shows a close-up schematic view of the region 4 in the electronic device 100 according to other embodiments of the disclosure

FIG. 8 shows a close-up schematic view of the region 4 in the electronic device 100 according to other embodiments of the disclosure. According to embodiments of the disclosure, since the electronic element 20 may include a plurality of functional unit 22, the circuits connecting a plurality of functional unit 22 may be independent or partially connected in series by controlling the design of the first conductive line 42 of the buffer conductive unit 32 and the second conductive line 44 in stretchable conductive unit 34, as shown in FIG. 8.

The conductive material layout density of the buffer conductive unit 32 may be controlled to be greater than the conductive material layout density of the stretchable conductive unit 34 by controlling the wire diameter of the conductive lines, resulting in that the yield strain of the stretchable conductive unit 34 is greater than the yield strain of the buffer conductive unit 32.

According to embodiments of the disclosure, in order to avoid the connection failure between the electronic element and the connecting element (or within connecting element) when bending or stretching flexible electronic device, the electrode of the electronic element, the buffer conductive unit and/or stretchable conductive unit of the electronic element may further include block portions.

Figure 9:
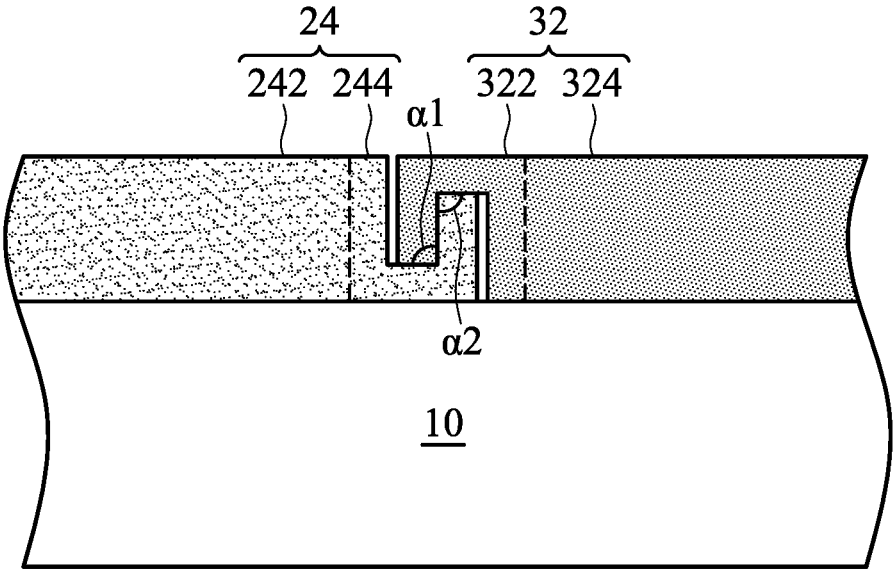
FIG. 9 shows a close-up schematic view of the contact region of the electrode 24 of the electronic element 20 and the buffer conductive unit 32 in the electronic device 100 according to some embodiments of the disclosure.
Figure 10:
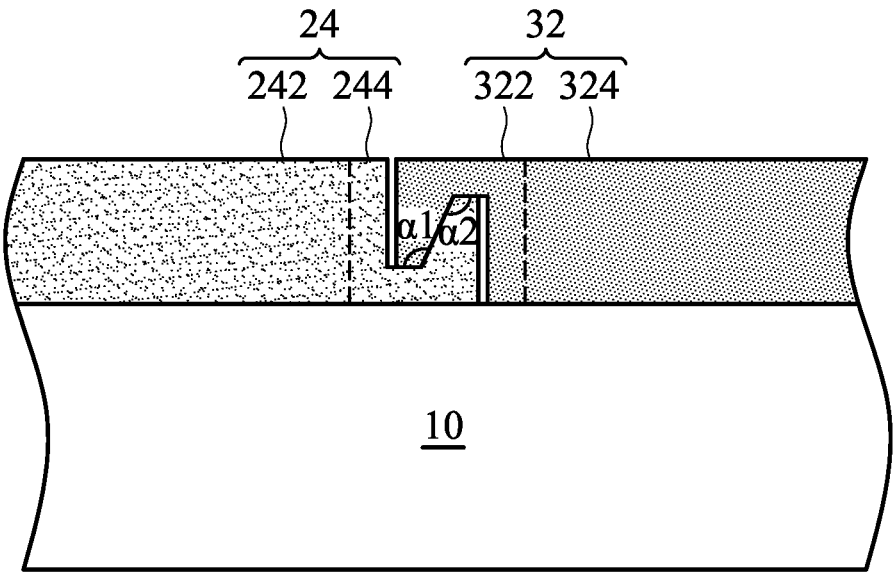
FIG. 10 shows a close-up schematic view of the contact region of the electrode 24 of the electronic element 20 and the buffer conductive unit 32 in the electronic device 100 according to some embodiments of the disclosure.
Figure 11:
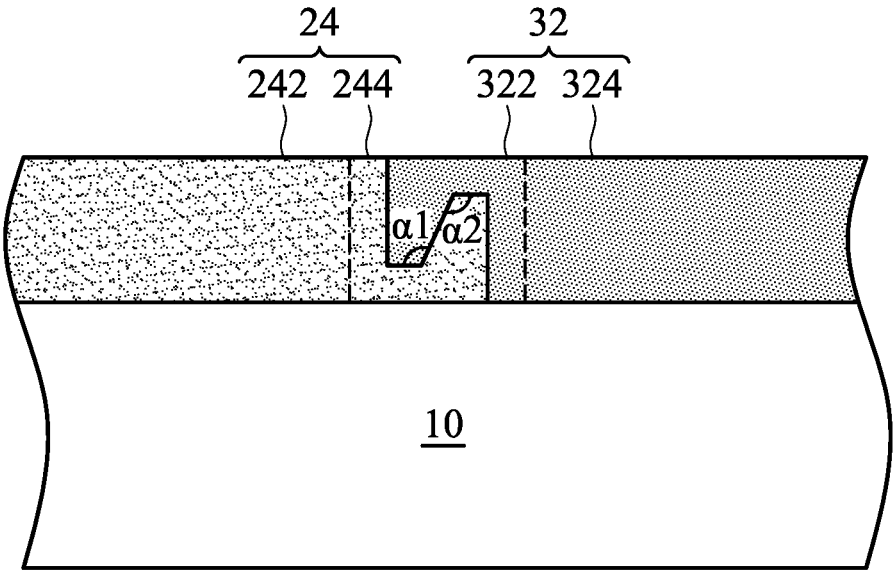
FIG. 11 shows a close-up schematic view of the contact region of the electrode 24 of the electronic element 20 and the buffer conductive unit 32 in the electronic device 100 according to some embodiments of the disclosure.

FIG. 9 shows a close-up schematic view of the contact region of the electrode 24 of the electronic element 20 and the buffer conductive unit 32 in the electronic device 100 according to some embodiments of the disclosure. The electrode 24 has a main portion 242 of the electrode and the block portion 244 of the electrode, and the buffer conductive unit 32 has a main portion 322 of the buffer conductive unit and the block portion 324 of the buffer conductive unit, wherein the block portion 244 of the electrode is engaged with the block portion 324 of the buffer conductive unit. As shown in FIG. 9, the electrode 24 and the buffer conductive unit 32 may be combined closely by the engaged block portion 244 of the electrode and the block portion 324 of the buffer conductive unit, thereby preventing the electrode 24 from becoming separated from the buffer conductive unit 32 when the flexible electronic device is bent or stretched. The buffer conductive unit block portion 244 has an internal angle $\alpha 1$, and the block portion 244 of the electrode has an internal angle $\alpha 2$, wherein the internal angle $\alpha 1$ and the internal angle $\alpha 2$ may be the same, and may be equal to or greater than 90 degrees and less than 180 degrees. As shown in FIG. 9, the internal angle $\alpha 1$ of the block portion 324 of the buffer conductive unit 32 and the internal angle $\alpha 2$ of the block portion 244 of the electrode 24 may be 90 degrees. According to embodiments of the disclosure, as shown in FIG. 10, the internal angle $\alpha 1$ of the block portion 324 of the buffer conductive unit 32 and the internal angle $\alpha 2$ of the block portion 244 of the electrode 24 may be greater than 90 degrees or less than 180 degrees. In addition, according to other embodiments of the disclosure, the block portion 244 of the electrode and the block portion 324 of the buffer conductive unit may be complementary in shape, thereby combining the electrode 24 and the buffer conductive unit 32 more closely, as shown in FIG. 11.

Figure 12:
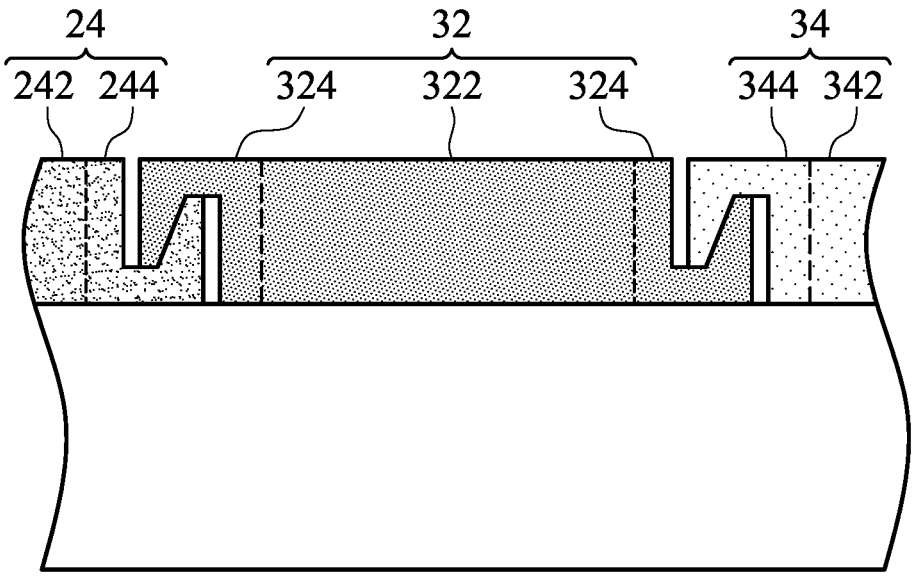
FIG. 12 shows a close-up schematic view of the contact region of the electrode 24 of the electronic element 20 and the buffer conductive unit 32, and the contact region of the buffer conductive unit 32 and the stretchable conductive unit 34 in the electronic device 100 according to some embodiments of the disclosure.

FIG. 12 shows a close-up schematic view of the contact region of the electrode 24 of the electronic element 20 and the buffer conductive unit 32, and the contact region of the buffer conductive unit 32 and the stretchable conductive unit 34 in the electronic device 100 according to some embodiments of the disclosure. As shown in FIG. 12, the electrode 24 has a main portion 242 of the electrode and the block portion 244 of the electrode, the buffer conductive unit 32 has the main portion 322 of the buffer conductive unit and the block portion 324 of the buffer conductive unit, and the stretchable conductive unit 34 has a main portion 342 of the stretchable conductive unit and a block portion 344 of the stretchable conductive unit. In this embodiment, the buffer conductive unit 32 may have two block portions 324 of the buffer conductive unit, wherein one block portion 324 is engaged with the block portion 244 of the electrode, and the other block portion 324 of the buffer conductive unit is engaged with the block portion 344 of the stretchable conductive unit, as shown in FIG. 12. The electrode 24, the stretchable conductive unit 34 and the buffer conductive unit 32 may be combined closely by the engaged block portion 244 of the electrode and the block portion 324 of the buffer conductive unit, thereby preventing the buffer conductive unit 32 from becoming separated from the electrode 24 and/or the stretchable conductive unit 34 when the flexible electronic device is bent or stretched.

According to embodiments of the disclosure, in order to avoid the connection failure between the electronic element and the connecting element (or within connecting element) when bending or stretching flexible electronic device, the electrode of the electronic element, the buffer conductive unit and/or stretchable conductive unit of the electronic element may further include a protruding portion/recessed portion.

Figure 13:
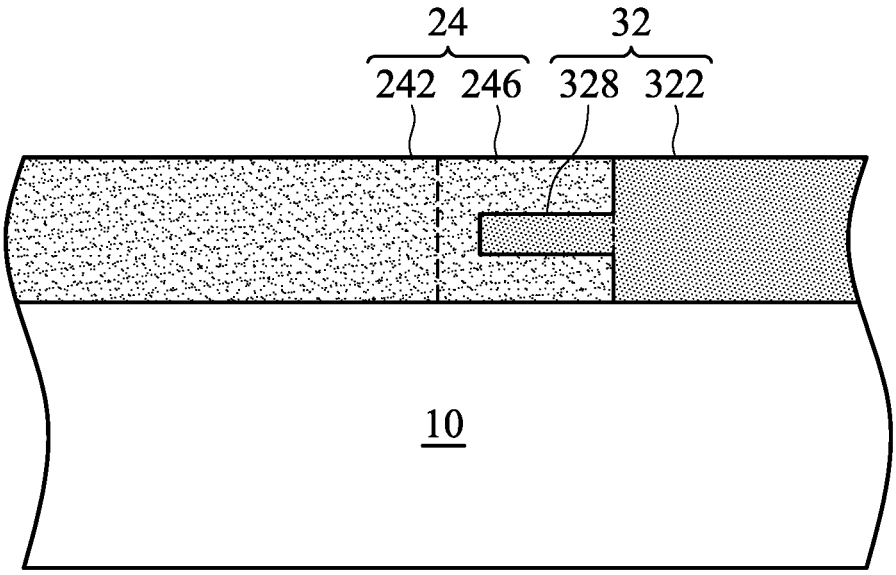
FIG. 13 shows a close-up schematic view of the contact region of the electrode 24 of the electronic element 20 and the buffer conductive unit 32 in the electronic device 100 according to some embodiments of the disclosure.
Figure 14:
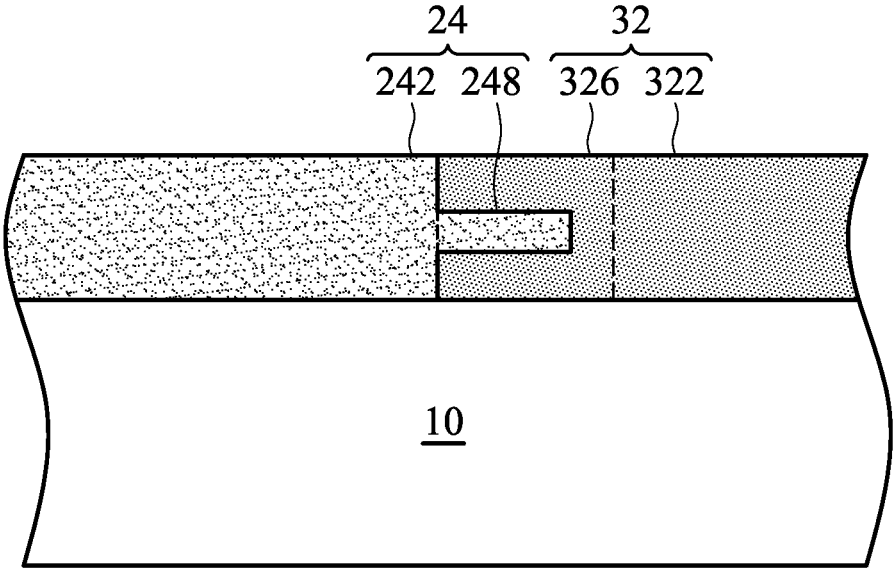
FIG. 14 shows a close-up schematic view of the contact region of the electrode 24 of the electronic element 20 and the buffer conductive unit 32 in the electronic device 100 according to some embodiments of the disclosure.

FIG. 13 shows a close-up schematic view of the contact region of the electrode 24 of the electronic element 20 and the buffer conductive unit 32 in the electronic device 100 according to some embodiments of the disclosure. The electrode 24 has the main portion 242 of the electrode and the recessed portion 246 of the electrode, and the buffer conductive unit 32 has a main portion 322 of the buffer conductive unit and a protruding portion 328 of the buffer conductive unit, wherein the recessed portion 246 of the electrode and the protruding portion 328 of the buffer conductive unit are complementary in shape in order to engage with each other, as shown in FIG. 13. Namely, the recessed portion 246 of the electrode and the protruding portion 328 of the buffer conductive unit may constitute a plug connection. By means of the engaged recessed portion 246 of the electrode and the protruding portion 328 of the buffer conductive unit, the electrode 24 and the buffer conductive unit 32 may be combined closely, thereby preventing the electrode 24 from becoming separated from the buffer conductive unit 32 when the flexible electronic device is bent or stretched. FIG. 14 shows a close-up schematic view of the contact region of the electrode 24 of the electronic element 20 and the buffer conductive unit 32 in the electronic device 100 according to some embodiments of the disclosure. The electrode 24 has a main portion 242 of the electrode and the protruding portion 248 of the electrode, and the buffer conductive unit 32 has the main portion 322 of the buffer conductive unit and the recessed portion 326 of the buffer conductive unit, wherein the protruding portion 248 of the electrode and the recessed portion 326 of the buffer conductive unit may be complementary in shape in order to engage with each other, as shown in FIG. 14.

Figure 15:
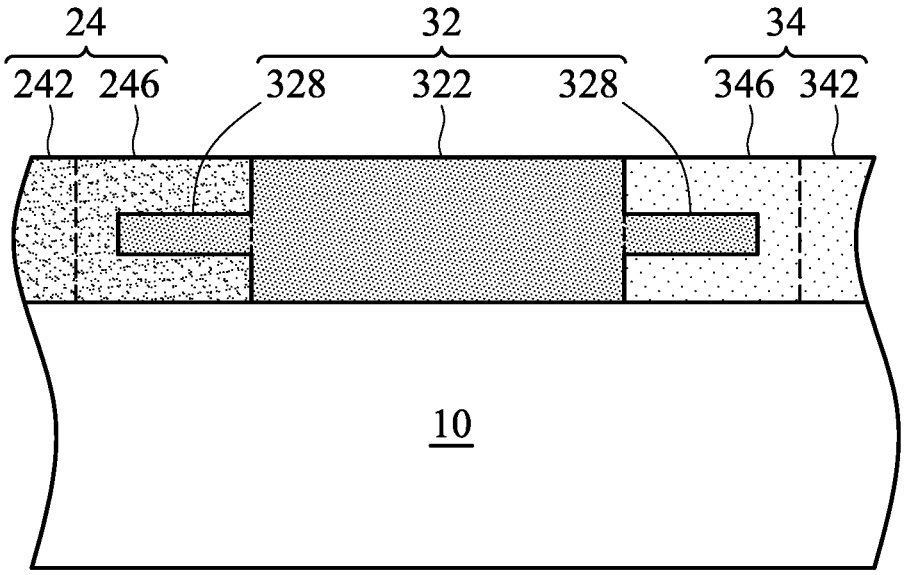
FIG. 15 shows a close-up schematic view of the contact region of the electrode 24 of the electronic element 20 and the buffer conductive unit 32, and the contact region of the buffer conductive unit 32 and the stretchable conductive unit 34 in the electronic device 100 according to some embodiments of the disclosure.

FIG. 15 shows a close-up schematic view of the contact region of the electrode 24 of the electronic element 20 and the buffer conductive unit 32, and the contact region of the buffer conductive unit 32 and the stretchable conductive unit 34 in the electronic device 100 according to some embodiments of the disclosure. As shown in FIG. 15, the electrode 24 has the main portion 242 of the electrode and the recessed portion 246 of the electrode, the buffer conductive unit 32 has the main portion 322 of the buffer conductive unit and the protruding portion 328 of the buffer conductive unit, and the stretchable conductive unit 34 has the main portion 342 of the stretchable conductive unit and the recessed portion 346 of the stretchable conductive unit. In this embodiment, the buffer conductive unit 32 may have two protruding portions 328 of the buffer conductive unit, wherein one protruding portion 328 of the buffer conductive unit may be complementary in shape with the recessed portion 246 of the electrode in order to engage with each other, and the other protruding portion 328 of the buffer conductive unit may be complementary in shape with the recessed portion 346 of the stretchable conductive unit in order to engage with each other.

Figure 16:
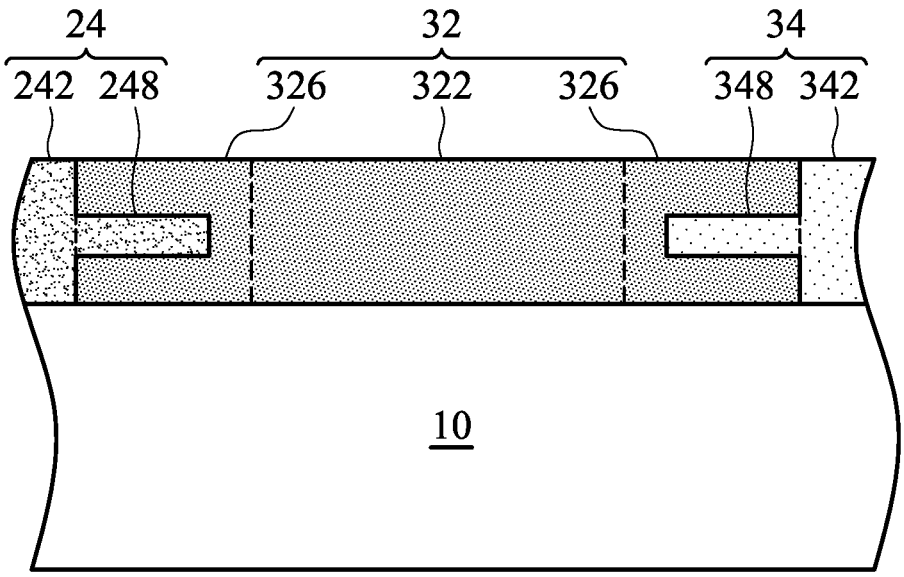
FIG. 16 shows a close-up schematic view of the contact region of the electrode 24 of the electronic element 20 and the buffer conductive unit 32, and the contact region of the buffer conductive unit 32 and the stretchable conductive unit 34 in the electronic device 100 according to some embodiments of the disclosure.

FIG. 16 shows a close-up schematic view of the contact region of the electrode 24 of the electronic element 20 and the buffer conductive unit 32, and the contact region of the buffer conductive unit 32 and the stretchable conductive unit 34 in the electronic device 100 according to some embodiments of the disclosure. As shown in FIG. 16, the electrode 24 has the main portion 242 of the electrode and a protruding portion 248 of the electrode, the buffer conductive unit 32 has the main portion 322 of the buffer conductive unit and the recessed portion 326 of the buffer conductive unit and the stretchable conductive unit 34 has the main portion 342 of the stretchable conductive unit and the protruding portion 348 of the stretchable conductive unit. In this embodiment, the buffer conductive unit 32 may have two recessed portion 326 of the buffer conductive unit, wherein one recessed portion 326 of the buffer conductive unit may be complementary in shape with the protruding portion 248 of the electrode in order to engage with each other, and the other recessed portion 326 of the buffer conductive unit may be complementary in shape with the protruding portion 348 of the stretchable conductive unit in order to engage with each other.

Figure 17:
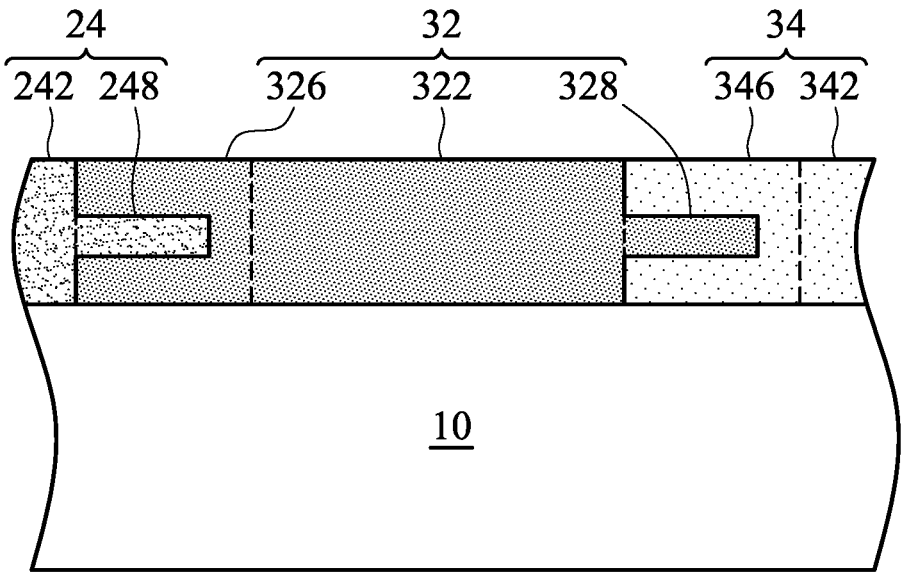
FIG. 17 shows a close-up schematic view of the contact region of the electrode 24 of the electronic element 20 and the buffer conductive unit 32, and the contact region of the buffer conductive unit 32 and the stretchable conductive unit 34 in the electronic device 100 according to some embodiments of the disclosure.

FIG. 17 shows a close-up schematic view of the contact region of the electrode 24 of the electronic element 20 and the buffer conductive unit 32, and the contact region of the buffer conductive unit 32 and the stretchable conductive unit 34 in the electronic device 100 according to some embodiments of the disclosure. As shown in FIG. 17, the electrode 24 has the main portion 242 of the electrode and the protruding portion 248 of the electrode, the buffer conductive unit 32 has the main portion 322 of the buffer conductive unit, the recessed portion 326 of the buffer conductive unit and the protruding portion 328 of the buffer conductive unit, and the stretchable conductive unit 34 has the main portion 342 of the stretchable conductive unit and the recessed portion 346 of the stretchable conductive unit. In this embodiment, the recessed portion 326 of the buffer conductive unit and the protruding portion 248 of the electrode may be complementary in shape in order to engage with each other; and, the protruding portion 328 of the buffer conductive unit and the recessed portion 346 of the stretchable conductive unit may be complementary in shape in order to engage with each other.

According to embodiments of the disclosure, the configuration and shape of the electrode of the electronic element, and the configuration and shape of the protruding portion/recessed portion of the buffer conductive unit and/or stretchable conductive unit are not limited and may be optionally modified by a person of ordinary skill in the field to ensure that the protruding portion may be engaged with the corresponding recessed portion to achieve a close combination of the elements. According to embodiments of the disclosure, the shape of the protruding portion/recessed portion may be selected based on actual requirements. For example, the cross section of the electrode of the electronic element, the protruding portion/recessed portion of the buffer conductive unit and/or stretchable conductive unit may be selected as needed in practice, and it may be polygon shaped, circle shaped, semi-circle shaped, oval shaped, semi-oval shaped, irregularly shaped, or a combination thereof. In the disclosure, irregular shaped means an asymmetrical polygon structure or a polygon structure with at least one curved side. In addition, according to embodiments of the disclosure, the orthogonal projection of the electrode of the electronic element onto the stretchable substrate and the orthogonal projection of the protruding portion/recessed portion of the buffer conductive unit and/or stretchable conductive unit onto the stretchable substrate may be polygon shaped, circle shaped, semi-circle shaped, oval shaped, semi-oval shaped, irregularly shaped, or a combination thereof.

According to embodiments of the disclosure, in order to reduce the RC delay of the electronic device and the resistance between the electronic elements, the number of connecting elements or the area of connecting elements between the electronic elements may be increased.

Figure 18:
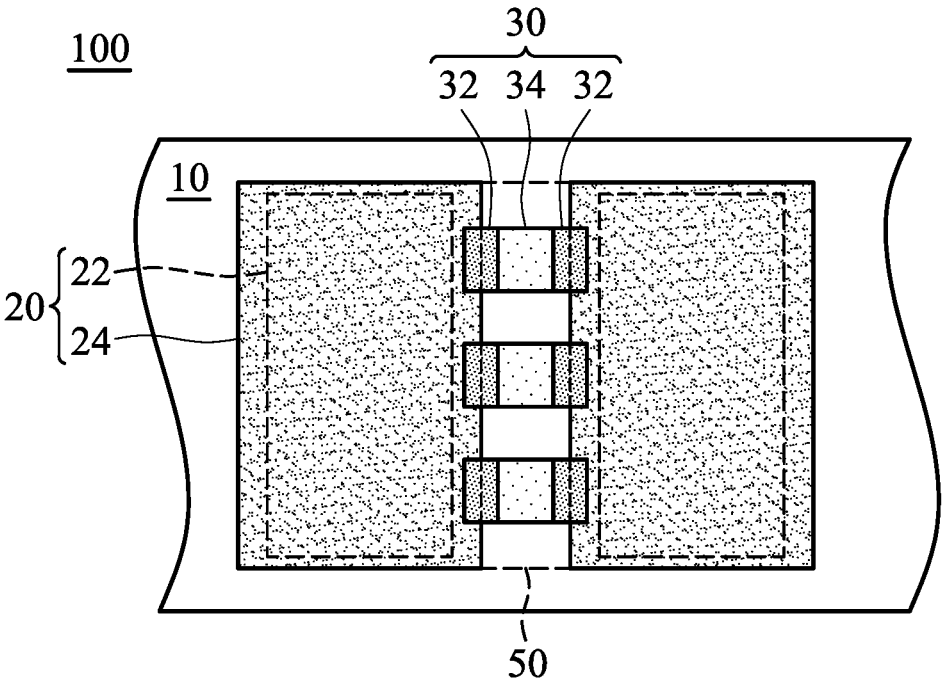
FIG. 18 shows a schematic top view of the electronic device 100 according to some embodiment of the disclosure.

FIG. 18 shows a schematic top view of the electronic device 100 according to some embodiment of the disclosure. The electronic device 100 includes a stretchable substrate 10 and a plurality of electronic elements 20. The two adjacent electronic elements 20 may be separated from each other by a space 50. The electronic device 100 may include a plurality of connecting element 30 (such as three connecting elements 30), wherein the orthogonal projection of each connecting element 30 onto the stretchable substrate 10 is at least partially overlapped with the orthogonal projection of the space 50 onto the stretchable substrate 10. Herein, the area of the orthogonal projection of the connecting element 30 disposed between two adjacent electronic elements 20 onto the stretchable substrate 10 may be less than the area of the orthogonal projection of the space 50 onto the stretchable substrate 10.

Figure 19:
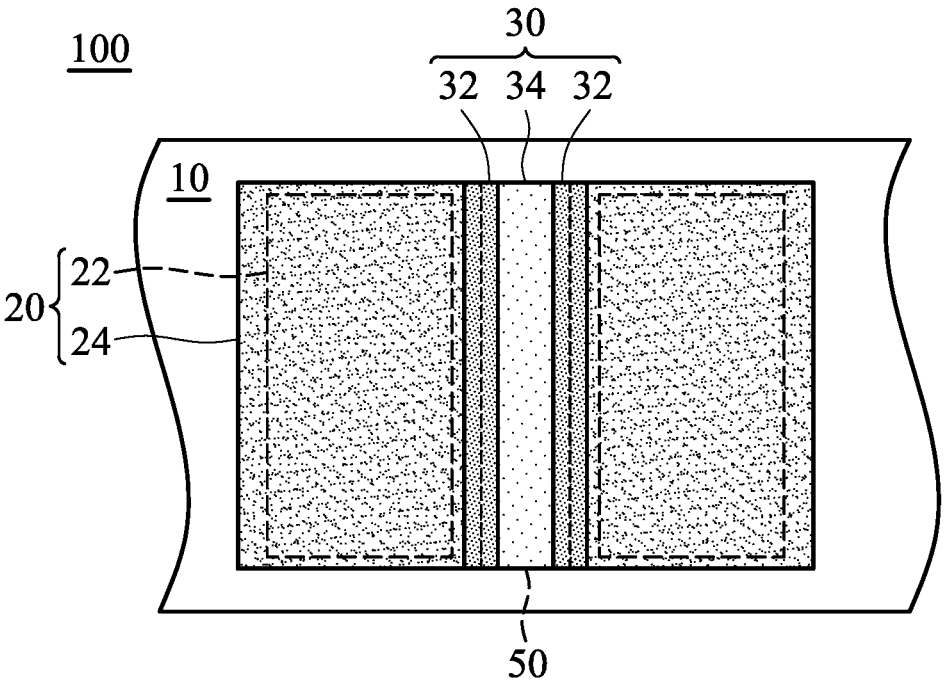
FIG. 19 shows a schematic top view of the electronic device 100 according to some embodiment of the disclosure.

In addition, according to embodiments of the disclosure, the orthogonal projection of the connecting element 30 disposed between two adjacent electronic elements 20 onto the stretchable substrate 10 may completely overlap the orthogonal projection of the space 50 onto the stretchable substrate 10, as shown in FIG. 19. As a result, the RC delay of the electronic device and the resistance between the electronic elements may be further reduced.

It will be clear that various modifications and variations can be made to the disclosed devices, methods and materials. It is intended that the specification and examples be considered as exemplary only, with the true scope of the disclosure being indicated by the following claims and their equivalents.

What is claimed is:

1. An electronic device, comprising:

a stretchable substrate;

a plurality of electronic elements, disposed on the stretchable substrate, wherein each electronic element comprises a functional unit and an electrode, wherein the electrode is in direct contact with the functional unit;

at least one connecting element disposed between two adjacent electronic elements, wherein the two adjacent electronic elements are electrically connected to each other via the connection element, wherein each connecting element comprises:

at least one stretchable conductive unit; and at least one buffer conductive unit, wherein the buffer conductive unit contacts the electrode, and the stretchable conductive unit is electrically connected to the electrode through the buffer conductive unit, and wherein yield strain of the stretchable conductive unit is greater than yield strain of the buffer conductive unit.

2. The electronic device as claimed in claim 1, wherein the stretchable conductive unit does not directly contact the electrode.

3. The electronic device as claimed in claim 1, wherein the yield strain of the buffer conductive unit is greater than yield strain of the electrode.

4. The electronic device as claimed in claim 1, wherein the yield strain of the stretchable conductive unit is from 1% to 30%.

5. The electronic device as claimed in claim 1, wherein the yield strain of the buffer conductive unit is from 0.5% to 6%.

6. The electronic device as claimed in claim 1, wherein the buffer conductive unit consists of a first material, and the stretchable conductive unit consists of a second material, wherein the first material is distinct from the second material, and yield strain of the second material is greater than yield strain of the first material.

7. The electronic device as claimed in claim 6, wherein Young's modulus of the first material is greater than Young's modulus of the second material.

8. The electronic device as claimed in claim 1, wherein the buffer conductive unit and the stretchable conductive unit are made of the same conductive material, wherein the conductive material layout density of the buffer conductive unit is greater than the conductive material layout density of the stretchable conductive unit.

9. The electronic device as claimed in claim 8, wherein the conductive material of the buffer conductive unit and the conductive material of the stretchable conductive unit are patterned such that the yield strain of the stretchable conductive unit is greater than the yield strain of the buffer conductive unit.

10. The electronic device as claimed in claim 8, wherein the buffer conductive unit comprises n number of a first conductive line, and the stretchable conductive unit comprises m number of a second conductive line, wherein the first conductive line and the second conductive line have the same wire diameter, and n is greater than m.

11. The electronic device as claimed in claim 8, wherein the buffer conductive unit comprises n number of a first conductive line, and the stretchable conductive unit comprises m number of a second conductive line, wherein the wire diameter of the first conductive line is greater than the wire diameter of the second conductive line, and wherein n is equal to m.

12. The electronic device as claimed in claim 1, wherein the electrode has a block portion of electrode, and the buffer conductive unit has a first block portion of the buffer conductive unit, wherein the block portion of the electrode is engaged with the first block portion of the buffer conductive unit.

13. The electronic device as claimed in claim 12, wherein the block portion of the electrode has an internal angle, and the first block portion of the buffer conductive unit has an internal angle, wherein the internal angle of the block portion of the electrode is equal to or greater than 90 degrees and less than 180 degrees, and the internal angle of the first block portion of the buffer conductive unit is equal to or greater than 90 degrees and less than 180 degrees.

14. The electronic device as claimed in claim 12, wherein the buffer conductive unit has a second block portion of the buffer conductive unit, the stretchable conductive unit has a block portion of the stretchable conductive unit, wherein the second block portion of the buffer conductive unit is engaged with the block portion of the stretchable conductive unit.

15. The electronic device as claimed in claim 14, wherein the second block portion of the buffer conductive unit has an internal angle, and the block portion of the stretchable conductive unit has an internal angle, wherein the internal angle of the second block portion of the buffer conductive unit is equal to or greater than 90 degrees and less than 180 degrees, and the internal angle of the block portion of the stretchable conductive unit is equal to or greater than 90 degrees and less than 180 degrees.

16. The electronic device as claimed in claim 1, wherein the electrode has a protruding portion of the electrode and the buffer conductive unit has a recessed portion of the buffer conductive unit, wherein the protruding portion of the electrode and the recessed portion of the buffer conductive unit are complementary in shape, to engage with each other; or, wherein the electrode has a recessed portion of the electrode and the buffer conductive unit has a protruding portion of the buffer conductive unit, wherein the recessed portion of the electrode and the protruding portion of the buffer conductive unit are complementary in shape to engage with each other.

17. The electronic device as claimed in claim 1, wherein the buffer conductive unit has a protruding portion of the buffer conductive unit and the stretchable conductive unit has a recessed portion of the stretchable conductive unit, wherein the protruding portion of the buffer conductive unit and the recessed portion of the stretchable conductive unit are complementary in shape to engage with each other; or, wherein the buffer conductive unit has a recessed portion of the buffer conductive unit and the stretchable conductive unit has a protruding portion of the stretchable conductive unit, wherein the recessed portion of the buffer conductive unit and the protruding portion of the stretchable conductive unit are complementary in shape to engage with each other.

18. The electronic device as claimed in claim 1, wherein two adjacent electronic elements are separated from each other by a space, wherein an orthogonal projection of the connecting element disposed between the two adjacent electronic elements onto the stretchable substrate completely overlaps an orthogonal projection of the space onto the stretchable substrate.

19. The electronic device as claimed in claim 1, wherein two adjacent electronic elements are separated from each other by a space, wherein an orthogonal projection of the connecting element disposed between the two adjacent electronic elements onto the stretchable substrate has an area which is less than an area of an orthogonal projection of the space onto the stretchable substrate.

20. The electronic device as claimed in claim 1, wherein the connecting element has two buffer conductive units and one stretchable conductive unit, wherein the stretchable conductive unit is disposed between the two buffer conductive units.

* * * * *